US005872563A

United States Patent [19]

Asada

[11] Patent Number: 5,872,563

[45] Date of Patent: Feb. 16, 1999

[54] SCANNING CIRCUIT FOR IMAGE DEVICE AND DRIVING METHOD FOR SCANNING CIRCUIT

[75] Inventor: Hideki Asada, Tokyo, Japan

[73] Assignee: NEC Corporation, Tokyo, Japan

[21] Appl. No.: 334,331

[22] Filed: Nov. 2, 1994

[30] Foreign Application Priority Data

Nov. 11, 1993 [JP] Japan ..... 5-282243

[51] Int. Cl.[6] ..... G09G 5/00

[52] U.S. Cl. ..... 345/212; 345/100

[58] Field of Search ..... 345/197, 212, 345/100, 198

[56] References Cited

U.S. PATENT DOCUMENTS

| | | | |
|---|---|---|---|
| 2,998,192 | 8/1961 | Florida | 235/164 |
| 4,570,115 | 2/1986 | Misawa et al. | 345/212 |
| 5,237,314 | 8/1993 | Knapp | 345/84 |
| 5,282,234 | 1/1994 | Murayama et al. | 345/87 |
| 5,404,151 | 4/1995 | Asada | 345/100 |

FOREIGN PATENT DOCUMENTS

| | | | |
|---|---|---|---|
| 2-207299 | 8/1990 | Japan | 345/212 |
| 4-22922 | 1/1992 | Japan | 345/197 |
| 4-204993 | 7/1992 | Japan | 345/212 |
| 591-883 | 3/1978 | U.S.S.R. | 345/197 |

OTHER PUBLICATIONS

Takafuji et al., "25.3: A 1.9–in. 1.5–MPixel Driver Fully–Integrated Poly–Si TFT–LCD for HDTV Projection", SID 93 Digest, (1993), pp. 383–386.

Matsueda et al., "HDTV Poly–Si TFT–LCD Light Valve with 70% Aperture Ratio", pp. 601–604.

*Primary Examiner*—Richard Hjerpe
*Assistant Examiner*—Vui T. Tran
*Attorney, Agent, or Firm*—Foley & Lardner

[57] ABSTRACT

A bidirectional scanning circuit for a peripheral driving circuit for a liquid crystal display, a contact-type image sensor, a liquid crystal shutter, a vacuum fluorescent display or the like is improved in operation speed and yield in production. In the scanning circuit, a data signal is successively delayed and transferred to produce scanning pulse signals to be outputted. The scanning circuit comprises a plurality of switching transistors connected in cascade connection such that each switching transistor receives a data signal outputted from a preceding switching transistor and passes the data signal so as to be applied to a following switching transistor in response to a pair of clock signals, a plurality of feedback circuits each for receiving a signal outputted from a corresponding switching transistor in response to a further pair of clock signals and compensating for a drop of the signal level of the thus received signal, and a plurality of buffer circuits for individually receiving signals successively outputted from the feedback circuits and individually outputting the received signals as scanning pulse signals.

5 Claims, 5 Drawing Sheets

SCANNING CIRCUIT FOR IMAGE DEVICE AND DRIVING METHOD FOR SCANNING CIRCUIT

BACKGROUND OF THE INVENTION

1. Field of the Invention

This invention relates to a scanning circuit for an image device and a driving method for the scanning circuit, and more particularly to a scanning circuit used as a peripheral circuit for a liquid crystal display, a contact-type image sensor, a liquid crystal shutter and so forth, and a driving method for driving the scanning circuit.

2. Description of the Related Art

Conventionally, in order to minimize, reduce in cost and achieve a high reliability of a liquid crystal display, a contact-type image sensor, a liquid crystal shutter and so forth, a thin film transistor driving circuit which is used as a peripheral circuit for those apparatus is integrated on them. The manufacturing method is adopted based on the concept that, where a peripheral driving circuit is provided on the same substrate on which picture element electrodes of a liquid crystal display, a contact-type image sensor, a liquid crystal shutter or the like are provided, the number of connection terminals and the number of external driver integrated circuits (ICs) are decreased remarkably and the problem in reliability which arises from a limitation in the large area and high density bonding step can be solved.

Usually, a scanning circuit which is used as a peripheral circuit for a liquid crystal display, a contact-type image sensor, a liquid crystal shutter or the like consists of a shift register and an output buffer. For example, in an active matrix liquid crystal display, the scanning circuit serves as a vertical driving circuit or a circuit for scanning sample and hold switches in a horizontal driving circuit and makes an important component which forms a thin film transistor driving circuit described above.

In a liquid crystal projector which is being spread as a large screen projection type display in recent years, an image for one of three liquid crystal light valves corresponding to the three primary colors of red, green and blue must be reversed by a mirror due to a difference among the number of reflections of light passing though the liquid crystal light valves. In order to achieve such mirror reversal, either the scanning direction of a vertical scanning circuit is reversed or the liquid crystal light valve is rotated by 180 degrees and the scanning direction of a horizontal scanning circuit is reversed. To this end, a bidirectional scanning circuit in which data can be switchably transferred leftwardly or rightwardly is required.

FIG. 4 shows the schematic diagram of a conventional bidirectional scanning circuit. Referring to FIG. 4, the conventional bidirectional scanning circuit has an input terminal STR to which a right shift start pulse signal is inputted and another input terminal STL to which a left shift start pulse signal is inputted. The conventional bidirectional scanning circuit includes N (N is a positive integral number) selection circuits 401-1 to 401-N, N shift registers 405-1 to 405-N of the half-bit configuration corresponding to the N selection circuits 401-1 to 401-N and having a function of delaying and transferring a pulse signal, and N output buffer circuits 406-1 to 406-N for outputting the outputs of the shift registers 405-1 to 405-N as outputs OUT1 to OUT(N), respectively. Each selection circuit, 401-1 to 401-N, consists of a pair of AND circuits 402 and 403 and an OR circuit 404. Meanwhile, each output buffer circuit, 406-1 to 406-N, consists of a pair of invertors 407 and 408.

FIGS. 5 and 6 illustrate operation timings of the conventional bidirectional scanning circuit shown in FIG. 4. The curves (a), (b), (c), (d), (e), (f), (g), (h), (i) and (j) of FIG. 5 show waveforms of different signals in the bidirectional scanning circuit of FIG. 4, when a pulse signal is transferred in the rightward direction from the left end of the bidirectional scanning circuit in FIG. 4, while the curves (a), (b), (c), (d), (e), (f), (g), (h), (i) and (J) of FIG. 6 show waveforms of such signals, when a pulse signal is transferred in the leftward direction from the right end of the bidirectional scanning circuit in FIG. 4. Operation of the conventional bidirectional scanning circuit will be described below with reference to FIGS. 4, 5 and 6.

In rightward shifting wherein a right shift start pulse is inputted to the input terminal STR and transferred in the rightward direction from the left end of the bidirectional scanning circuit in FIG. 4, the other input terminal STL is set to an open state. The right shift start pulse from the input terminal STR is inputted to the AND circuit 403 included in the selection circuit 401-1. Meanwhile, an input signal A to be inputted to the other input terminal of the AND circuit 403 is set to a high level and another input signal B to be inputted to an input terminal of the AND circuit 402 is set to a low level. Due to the input level settings to the AND circuit 402 and the AND circuit 403 Just described, the AND circuit 403 to which the input signal A of the high level is inputted is selected. This similarly applies to the AND circuits 402 and 403 included in the selection circuits 401-2 to 401-N, and the AND circuits 403 are selected in response to the input signal A of the high level, thereby forming a rightwardly shifting scanning circuit.

The right shift start pulse inputted from the input terminal STR is inputted to the shift register 405-1 by way of the AND circuit 403 and the OR circuit 404, and a pair of clock signals $\phi 1$ and $\phi 2$ (which is inverted clock signal of $\phi 1$ are inputted also to the shift register 405-1. Thus, the timing of a signal to be outputted from the shift register 405-1 is controlled by the clock signals $\phi 1$ and $\phi 2$, and a scanning pulse signal is outputted as an output signal OUT1 by way of the output buffer circuit 406-1. The signal outputted from the shift register 405-1 is inputted to the AND circuit 403 included in the selection circuit 401-2 at the next stage so that it is inputted to the shift register 405-2 by way of the AND circuit 403 and the OR circuit 404. The operation of the shift register 405-2 then is quite similar to the operation of the shift register 405-1 described above in that the timing of a signal to be outputted from the shift register 405-2 is controlled by the clock signals $\phi 1$ and $\phi 2$ and a scanning pulse signal is outputted as an output signal OUT2 from the shift register 405-2 by way of the output buffer circuit 406-2. The scanning pulse signal is simultaneously inputted also to the AND circuit 403 included in the selection circuit 401-3 at the next stage. Thereafter, a scanning pulse signal is outputted as an output signal OUT(N−1) from the N−1th output buffer circuit 406-(N−1) in a similar manner as described above, and a scanning pulse signal is outputted as an output signal OUT(N) from the Nth output buffer circuit 406-N. In this manner, successively shifted scanning pulse signals are outputted as output signals OUT1, . . . , OUT (N−1) and OUT(N) in this order (refer to FIG. 5).

On the other hand, in leftward shifting wherein a left shift start pulse is inputted to the input terminal STL and transferred in the leftward direction from the right end of the bidirectional scanning circuit in FIG. 4, the other input terminal STR is set to an open state. The left shift start pulse from the input terminal STL is inputted to the AND circuit 402 included in the selection circuit 401-N. Meanwhile, the input signal B to be inputted to the other input terminal of the AND circuit 402 is set to the high level and the input signal A to be inputted to an input terminal of the AND circuit 403 is set to the low level. Consequently, the AND circuit 402 to which the input signal B of the high level is inputted is selected. This similarly applies to the AND circuits 402 and 403 included in the selection circuits 401-1 to 401-(N−1), and the AND circuits 402 are selected in response to the input signal B of the high level so that a leftwardly shifting scanning circuit is formed.

The left shift start pulse signal inputted from the input terminal STL is inputted to the shift register 405-N by way of the AND circuit 402 and the OR circuit 404 included in the selection circuit 401-N, and the pair of clock signals $\phi 1$ and $\phi 2$ (which is inverted clock signal of $\phi 1$) are inputted to the shift register 405-N, and the timing of a signal to be outputted from the shift register 405-N is controlled by the clock signals $\phi$1 and $\phi 2$. A scanning pulse signal is outputted as an output signal OUT(N) by way of the output buffer circuit 406-N. The signal outputted from the shift register 405-N is inputted to the AND circuit 402 included in the selection circuit 401-(N−1) at the next stage so that it is inputted to the shift register 405-(N−1) by way of the AND circuit 402 and the OR circuit 404. The operation of the shift register 405-(N−1) then is quite similar to the operation of the shift register 405-N described above in that the timing of a signal to be outputted from the shift register 405-(N−1) is controlled by the clock signals $\phi 1$ and $\phi 2$ and a scanning pulse signal is outputted as an output signal OUT(N−1) from the shift register 405-(N−1) by way of the output buffer circuit 406-(N−1). Thereafter, a scanning pulse signal is outputted as an output signal OUT3 from the output buffer circuit 406-3 in a similar manner as described above, and scanning pulse signals are outputted as output signals OUT2 and OUT1 from the output buffer circuits 406-2 and 406-1, respectively. In this manner, successively shifted scanning pulse signals are outputted as output signals OUT(N), OUT (N−1), . . . and OUT1 in this order (refer to FIG. 6).

In the conventional bidirectional scanning circuit described above, since N stages of selection circuits are provided, corresponding additional lines must be provided. Such additional lines require a corresponding large circuit occupation area and provide a corresponding large capacitance, and consequently, it is difficult to minimize the bidirectional scanning circuit and increase the operation speed of the bidirectional scanning circuit. Accordingly, the conventional bidirectional scanning circuit is disadvantageous in that it cannot be applied to a liquid crystal display, a contact-type image sensor or a like apparatus which requires a high speed operation and a high resolution.

Further, since the conventional bidirectional scanning circuit has a large circuit occupation area, the yield in manufacture of scanning circuits is low. Furthermore, since the scanning circuit consists of shift registers connected in series, if only one of the shift registers fails, a scanning signal cannot be transferred regularly to circuits connected to those shift registers following the failed shift register. In a two-dimensional image apparatus such as a liquid crystal display, such incomplete transfer of a scanning signal causes a fatal image defect. Since the defect appears even where a picture element array section has no defect, there is a drawback in that the defect itself of the scanning circuit makes a factor which deteriorates the yield of devices.

SUMMARY OF THE INVENTION

It is an object of the present invention to provide a bidirectional scanning circuit which operates at a high speed and can be produced with a high yield and a driving method for the bidirectional scanning circuit.

In order to attain the object described above, according to an aspect of the present invention, there is provided a scanning circuit for an image device wherein a data signal is successively delayed and transferred in synchronism with a clock signal to produce scanning pulse signals to be outputted, comprising a plurality of switching transistors connected at a plurality of stages such that each of the switching transistors receives as an input signal thereto a data signal outputted from a preceding one of the switching transistors and is controlled by a single clock signal or a pair of clock signals having phases reverse to each other to pass the input signal as an output signal thereof which is applied as an input signal to a following one of the switching transistors, a plurality of feedback circuits each for receiving a corresponding one of signals successively outputted from the switching transistors, compensating for a drop of the signal level of the thus received signal and outputting a resulted signal, and a plurality of buffer circuits for individually receiving signals successively outputted from the feedback circuits and individually outputting the received signals as scanning pulse signals.

The scanning circuit may further comprise an additional switching transistor for receiving as an input signal thereto an output signal of that one of the switching transistors which corresponds to the last bit of the data signal and for being controlled by the single clock signal or the pair of clock signals having phases reverse to each other.

With the scanning circuit, a circuit for successively delaying and transferring a pulse signal from a preceding stage to a following stage is formed using a switching transistor. Consequently, the area occupied by the scanning circuit can be reduced to about one third that of conventional scanning circuits, and a layout of a scanning circuit wherein the circuit pitch is reduced for a high resolution liquid crystal display, contact-type image sensor or the like can be designed. Further, the yield in production of scanning circuits can be enhanced remarkably, and a bidirectional scanning circuit which operates at a high speed can be realized.

According to another aspect of the present invention, there is provided a driving method for the scanning circuit described above, comprising the steps of inputting a pair of clock signals having phases reverse to each other to control terminals of those of the switching transistors which correspond to each pair of adjacent bits of the data signal, and simultaneously inputting the clock signals having phase reverse to each other to control terminals of those of the feedback circuits which correspond to each pair of adjacent bits of the data signal. Clock signals having phases reverse to those of the clock signals which are inputted to the control terminals of those of the feedback circuits which correspond to each pair of adjacent bits of the data signal may be applied to the same control terminals so that the data signal is transferred in a reverse direction in the scanning circuit.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENT

Figure 1:
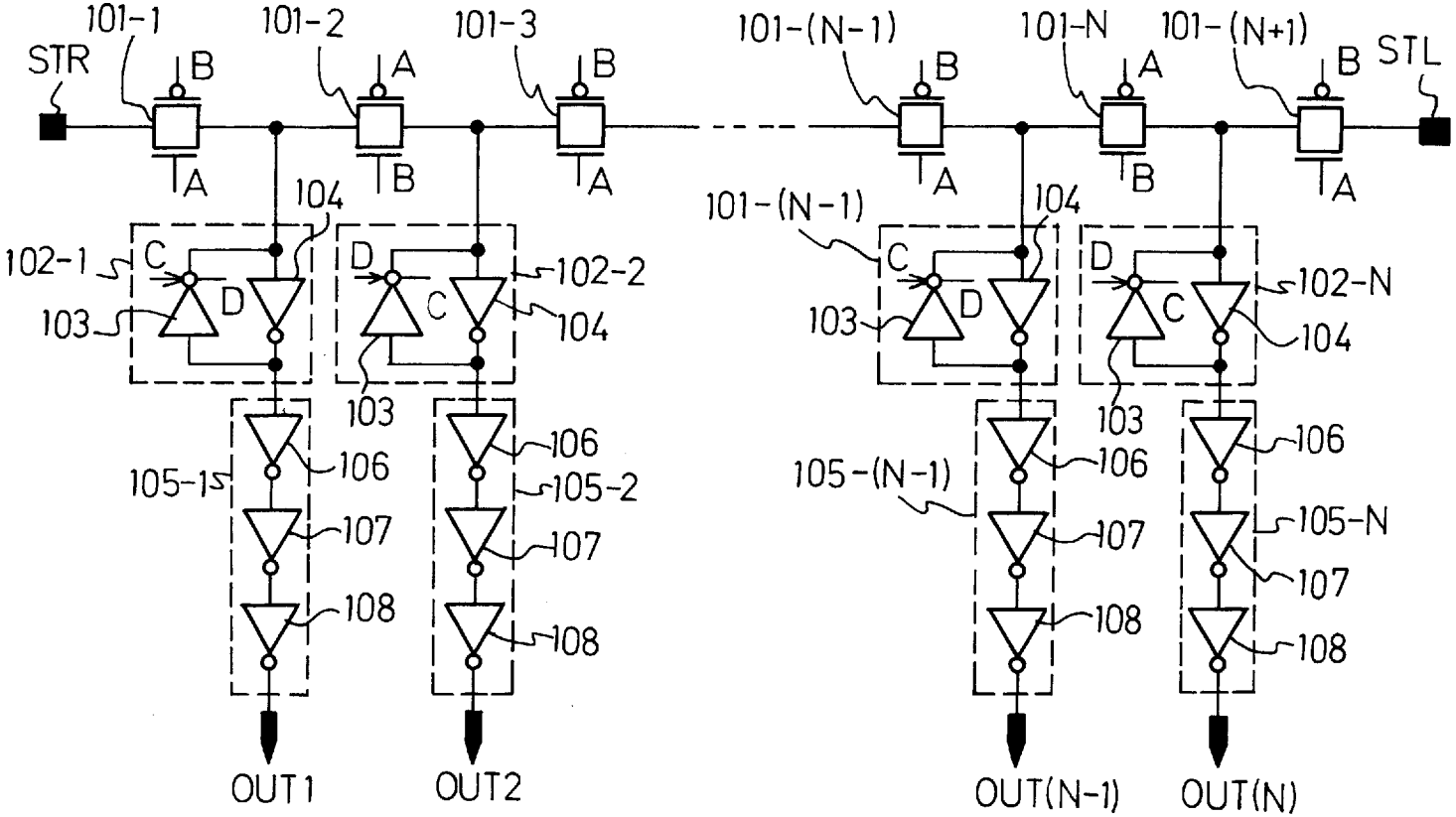
FIG. 1 is a block diagram of a scanning circuit for an image device showing a preferred embodiment of the present invention.
Figure 1A:
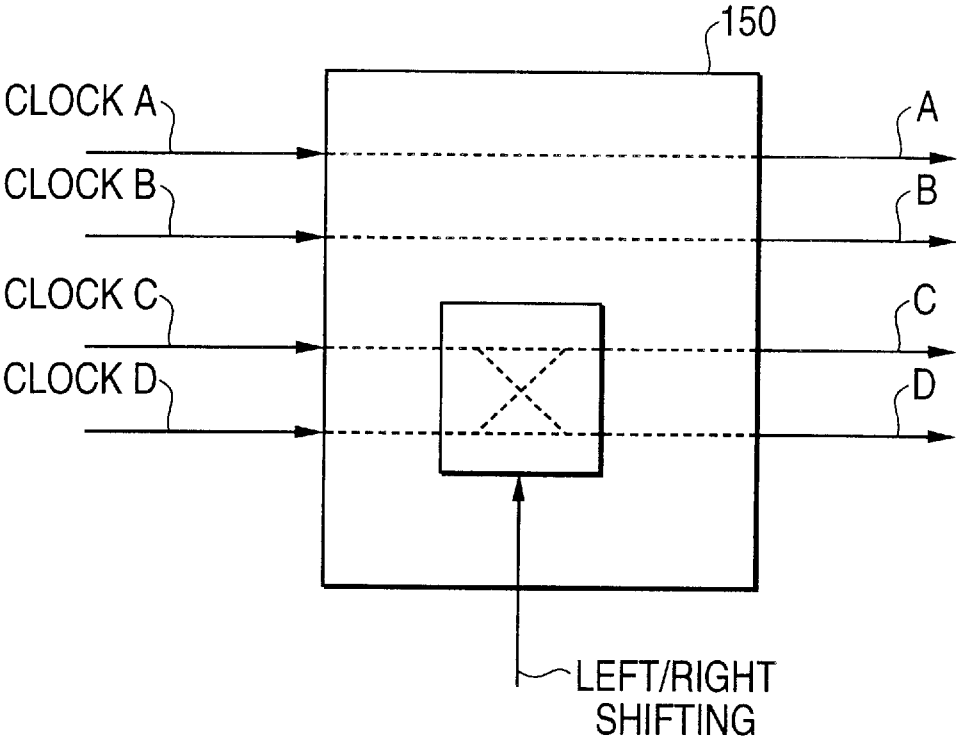
FIG. 1A is a block diagram of a clock applying circuit for an image device according to preferred embodiment of the invention.

Referring first to FIG. 1, there is shown a scanning circuit for an image device to which the present invention is applied. The scanning circuit shown has an input terminal STR to which a right shift start pulse signal is inputted and another input terminal STL to which a left shift start pulse signal is inputted. The scanning circuit includes N+1 (N is a positive integral number) switching transistors 101-1, . . . , 101-(N−1), 101-N, 101-(N+1) connected in cascade connection each for delaying and transferring a pulse signal from a switching transistor at a preceding stage to another switching transistor at a following stage in response to a pair of clock signals A and B, N feedback circuits 102-1, . . . , 102-(N−1) and 102-N controlled by clock signals C and D for preventing attenuation in amplitude of a pulse signal which is successively delayed and transferred by the switching transistors 101-1 to 101-(N+1), and N output buffer circuits 105-1, . . . , 105-(N−1) and 105-N for outputting the outputs of the feedback circuits 102-1, . . . , 102-(N−1) and 102-N as outputs OUT1, . . . , OUT(N−1) and OUT(N), respectively, of the scanning circuit. Each of the feedback circuits 102-1 to 102-N includes a clocked invertor 103 and an invertor 104. Meanwhile, each of the output buffer circuits 105-1 to 105-N includes three invertors 106, 107 and 108.

Figure 2:
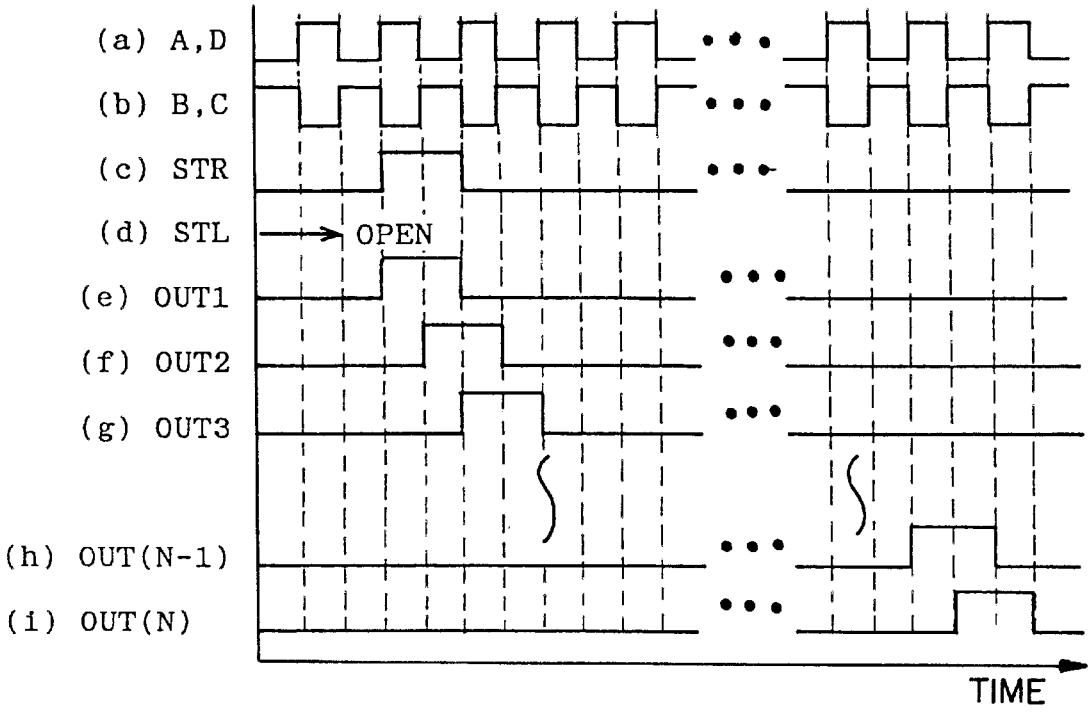
FIGS. 2 and 3 are time charts showing signal waveforms at different portions of the scanning circuit of FIG. 1 in a rightward shifting operation and a leftward shifting operation, respectively.
Figure 3:
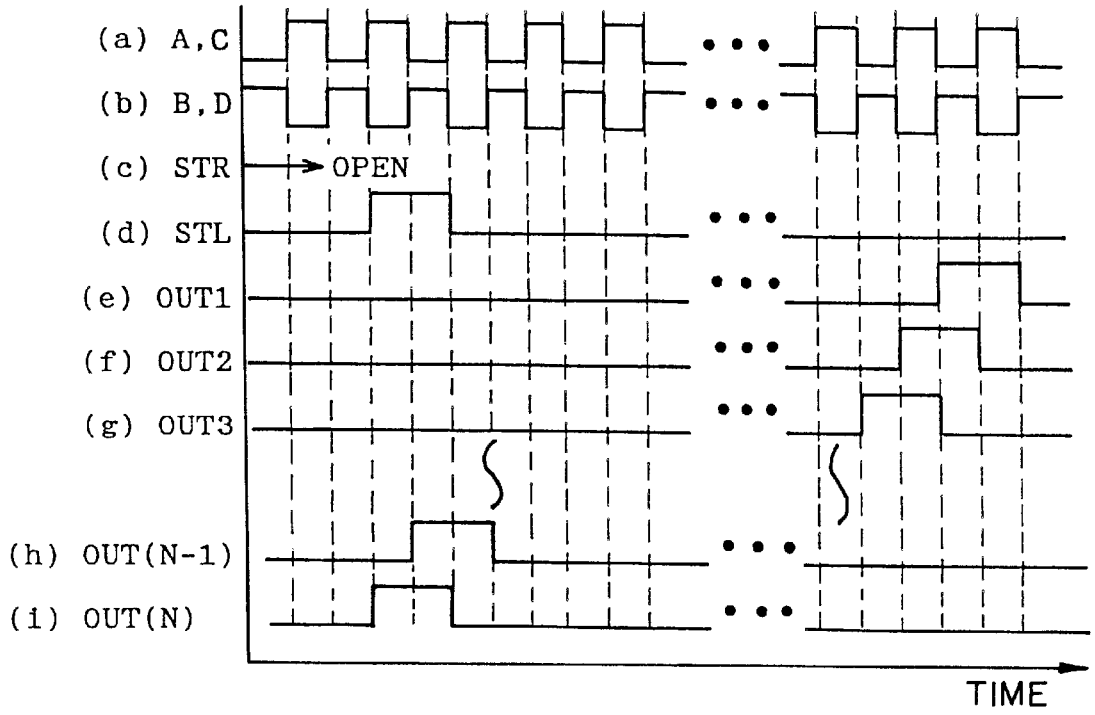
Figure 4:
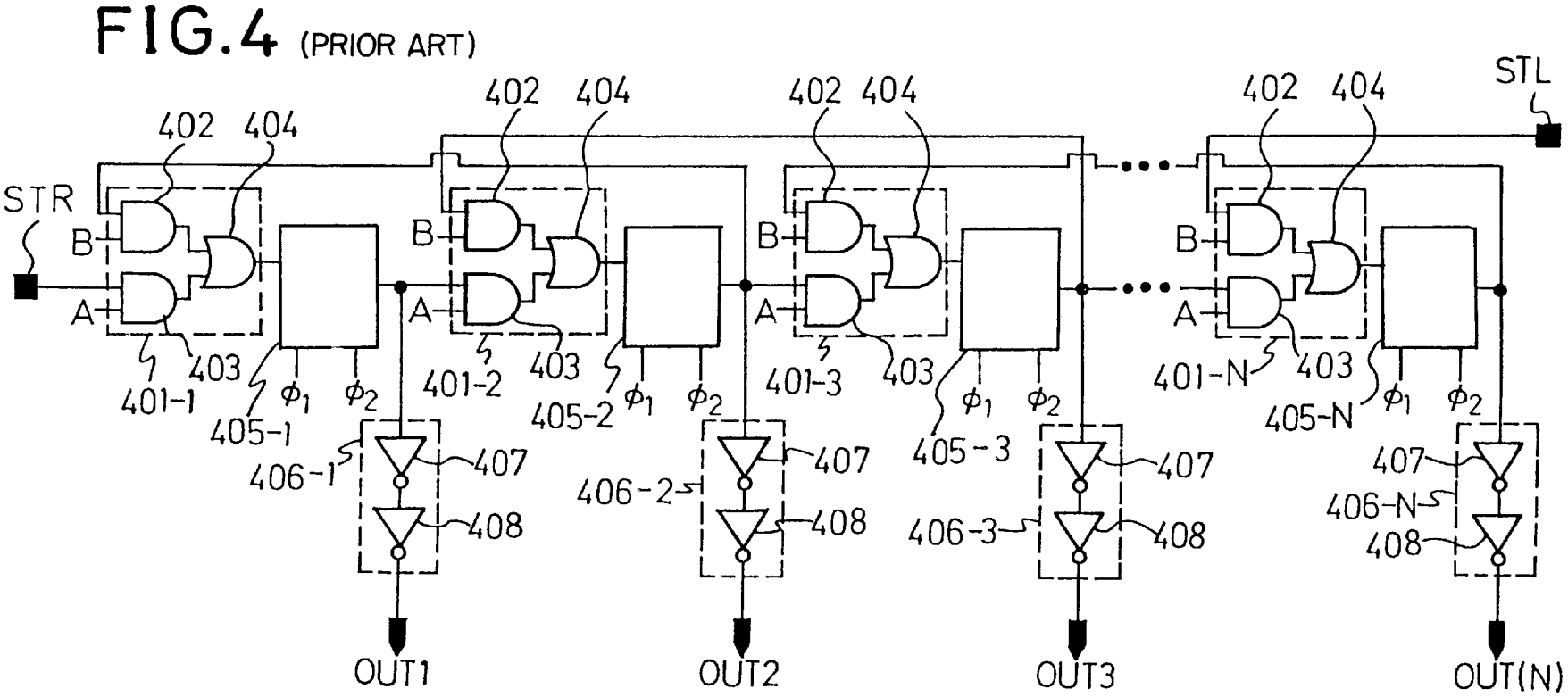
FIG.4 (PRIOR ART)
FIG. 4 is a block diagram showing a conventional scanning circuit.
Figure 5:
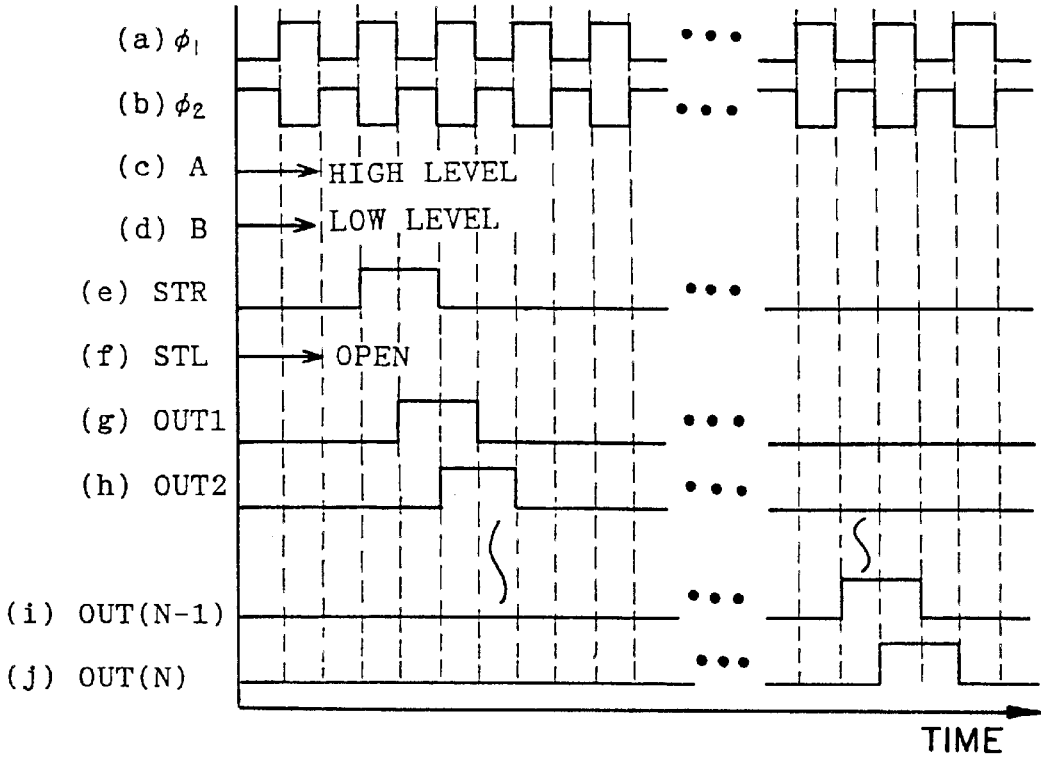
FIG.5 (PRIOR ART)
FIGS. 5 and 6 are time charts showing signal waveforms at different portions of the conventional scanning circuit of FIG. 4 in a rightward shifting operation and a leftward shifting operation, respectively.
Figure 6:
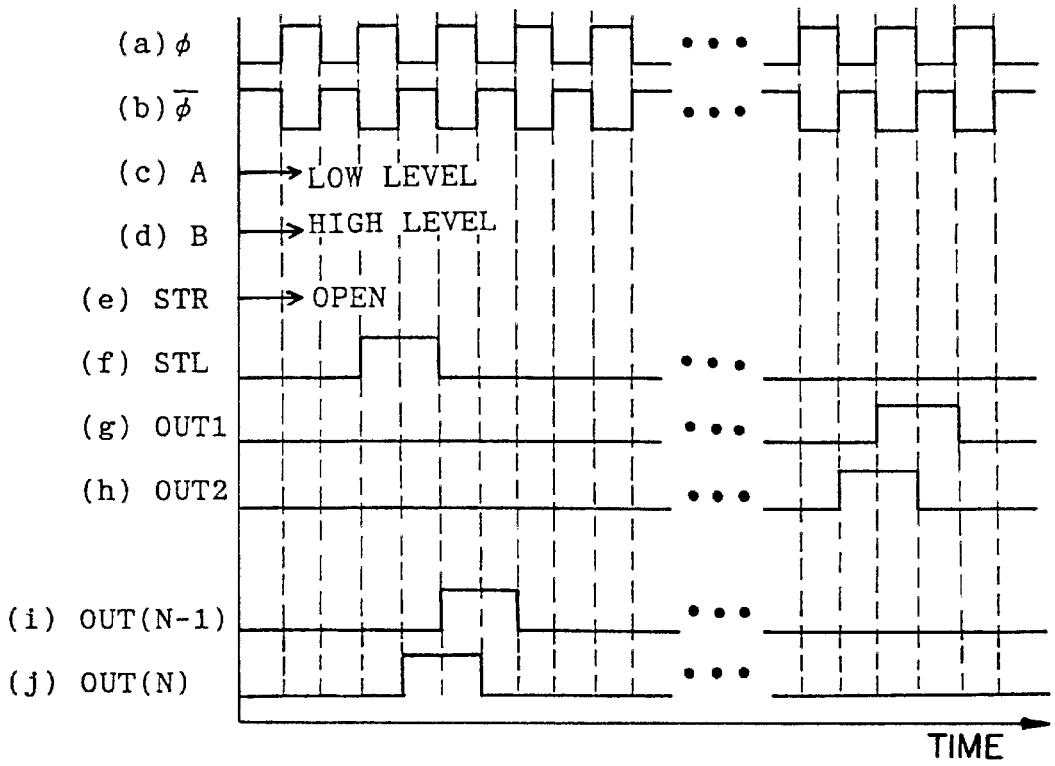
FIG.6 (PRIOR ART)

FIGS. 2 and 3 illustrate operation timings of the scanning circuit shown in FIG. 1. The curves (a), (b), (c), (d), (e), (f), (g), (h) and (i) of FIG. 2 show waveforms of different signals in the bidirectional scanning circuit of FIG. 1 when a pulse signal is transferred in the rightward direction from the left end of the scanning circuit in FIG. 1, while the curves (a), (b), (c), (d), (e), (f), (g), (h) and (i) of FIG. 3 illustrate waveforms of such signals when a pulse signal is transferred in the leftward direction from the right end of the scanning circuit in FIG. 1.

Operation of the scanning circuit will be described below with reference to FIGS. 1, 2 and 3. In rightward shifting wherein a right shift start pulse is inputted to the input terminal STR and transferred in the rightward direction from the left end of the scanning circuit in FIG. 1, the other input terminal STL is set to an open state. Here, the clock signals A and D are set to a common clock signal $\phi 1$, and the clock signals B and C are set to a common clock signal $\phi 2$ (inverted clock signal of $\phi 1$). By setting the clock signals A, B, C and D in this manner, a rightward shifting scanning circuit is formed, and successively shifted scanning pulse signals are outputted as output signals OUT1, . . . , OUT (N−1) and OUT(N) of the scanning circuit in this order from the output buffer circuits 105-1, . . . , 105-(N−1) and 105-N, respectively, (refer to FIG. 2).

On the other hand, in leftward shifting wherein a left shift start pulse is inputted to the input terminal STL and transferred in the leftward direction from the right end of the scanning circuit in FIG. 1, the other input terminal STR is set to an open state. In this instance, different from that in the rightward shifting described above, the clock signals A and C are set to the common clock signal $\phi 1$, and the clock signals B and D are set to the common clock signal $\phi 2$ (which is inverted clock signal of $\phi 1$). By setting the clock signals A, B, C and D in this manner, a leftward shifting scanning circuit is formed, and successively shifted scanning pulse signals are outputted as output signals OUT(N), OUT(N−1), . . . and OUT1 of the scanning circuit in this order from the output buffer circuits 105-N, 105-(N−1), . . . and 105-1, respectively (refer to FIG. 3). As described above, in the leftward shifting, the clock signals C and D are replaced with each other from those in the rightward shifting. Such replacement of the clock signals may be performed from the inside of the scanning circuit or from the outside of the scanning circuit.

Scanning circuits of 2,000 stages having the configuration of the scanning circuit of the embodiment described above were actually fabricated by integrating polycrystalline silicon thin film transistors on a glass substrate. When scanning circuits were manufactured with the pitch between them designed to 30 $\mu$m, the layout of the scanning circuits was successfully designed suppressing the occupied area of them to less than one third of that of conventional scanning circuits. While it was impossible to design the layout of conventional scanning circuits with the circuit pitch of 30 $\mu$m since selection circuits and areas required by additional lines for the selection circuits occupy a most part of the entire area, the present invention makes such designing possible. Further, since the circuit occupation area was reduced, also the yield in manufacture was enhanced. Particularly, in the scanning circuit of the present invention, since each portion for delaying and transferring a pulse signal from a preceding stage to a next stage consists of only a switching transistor, the probability with which a pulse signal is regularly transferred at least to the last stage exhibited an enhancement by 50% to 90% comparing with that of conventional scanning circuits. Consequently, the probability with which a fatal image defect appears on a two-dimensional image device such as a liquid crystal display can be reduced remarkably. Further, the maximum clock frequency at a supply voltage of 12 volts was enhanced from 5 MHz exhibited by conventional scanning circuits to 10 MHz or more, and a higher speed operation was realized.

It is to be noted that, while the scanning circuit in the embodiment described above is formed as a CMOS static circuit, the scanning circuit may alternatively be formed from an NMOS circuit. Further, while polycrystalline silicon thin film transistors are employed in the scanning circuit of the embodiment described above, the scanning circuit may be fabricated by integrating other thin film transistors which employ amorphous silicon or cadmium-selenium for the semiconductor layer. Furthermore, the scanning circuit may naturally be fabricated otherwise by integrating single crystalline silicon MOS transistors.

Having now fully described the invention, it will be apparent to one of ordinary skill in the art that many changes and modifications can be made thereto without departing from the spirit and scope of the invention as set forth herein.

What is claimed is:

1. A scanning circuit for an image device wherein a data signal is successively delayed and transferred in synchronism with a clock signal to produce scanning pulse signals to be outputted, the scanning circuit comprising:

N+1 pass transistors connected at a plurality of stages such that each of said pass transistors receives as an input signal thereto a data signal outputted from a preceding one of said pass transistors and is controlled by first and second clock signals having phases opposite to each other to output a corresponding data signal to a following one of said pass transistors, N being an integer;

N feedback circuits connected on a one-to-one basis to a first N stages of said N+1 pass transistors, each of said N feedback circuits receiving a corresponding one of the data signals successively outputted from said corresponding one of the pass transistors, the N feedback circuits compensating for a drop of a signal level of the received data signal and outputting a resulting signal, said N feedback circuits being controlled by third and fourth clock signals having phases opposite to each other, the first to fourth clock signals are inputted independently of each other;

N output buffer circuits connected on a one-to-one basis to said N feedback circuits, each of said N output buffer circuits receiving a corresponding one of the resulting signals outputted from said corresponding one of the feedback circuits, the N output buffer circuits outputting the received resulting signals as scanning pulse signals; and clock signal applying means for applying a driving condition to said feedback circuits, the driving condition being one of a first driving condition and a second driving condition, the first driving condition being a condition wherein the third clock signal and the fourth clock signal having a first phase characteristic with respect to each other are inputted to said feedback circuits so that the scanning pulse signals outputted from said N output buffer circuits are outputted in a forward direction order beginning with the first scanning pulse signal and ending with the Nth scanning pulse signal during the first driving condition, and said second driving condition being a condition wherein the third clock signal and the fourth clock signal having a second phase characteristic with respect to each other are inputted to said feedback circuits so that the scanning pulse signals outputted from said N output buffer circuits are outputted in a reverse direction order beginning with the Nth scanning pulse signal and ending with the first scanning pulse signal during the second driving condition, the second phase characteristic being different from the first phase characteristic.

2. A scanning circuit as claimed in claim 1, wherein the first phase characteristic is a characteristic where the first and the fourth clock signals have a same phase characteristic and the second and the third clock signals have a same phase characteristic, and wherein the second phase characteristic is a characteristic where the first and the third clock signals have a same phase characteristic and the second and the fourth clock signals have a same phase characteristic.

3. A scanning circuit for an image device wherein a data signal is successively delayed and transferred in synchronism with a clock signal to produce scanning pulse signals to be outputted, the scanning circuit comprising:

N+1 pass transistors connected at a plurality of stages such that each of said pass transistors receives as an input signal thereto a data signal outputted from a preceding one of said pass transistors and is controlled by first and second clock signals having phases opposite to each other to output a corresponding data signal to a following one of said pass transistors, N being an integer;

N feedback circuits connected on a one-to-one basis to a first N stages of said N+1 pass transistors, each of said N feedback circuits receiving a corresponding one of the data signals successively outputted from said corresponding one of the pass transistors, the N feedback circuits compensating for a drop of a signal level of the received data signal and outputting a resulting signal, said N feedback circuits being controlled by third and fourth clock signals having phases opposite to each other, the first to fourth clock signals are inputted independently of each other;

N output buffer circuits connected on a one-to-one basis to said N feedback circuits, each of said N output buffer circuits receiving a corresponding one of the resulting signals outputted from said corresponding one of the feedback circuits, the N output buffer circuits outputting the received resulting signals as scanning pulse signals; and clock signal applying means for applying the first to fourth clock signals such that, in a first state, the first and fourth clock signals have a same phase characteristic as each other and the second and third clock signals have a same phase characteristic as each other that is different from the phase characteristic of the first and fourth clock signals in the first state, the first state causing a shifting operation in a forward direction, and, in a second state, the first and third clock signals have a same phase characteristic as each other and the second and fourth clock signals have a same phase characteristic as each other that is different from the phase characteristic of the first and third clock signals in the second state, the second state causing a shifting operation in a reverse direction.

4. A scanning circuit for an image device wherein a data signal is successively delayed and transferred in synchronism with a clock signal to produce scanning pulse signals to be outputted, the scanning circuit comprising:

N+1 pass transistors connected at a plurality of stages such that each of said pass transistors receives as an input signal thereto a data signal outputted from a preceding one of said pass transistors and is controlled by first and second clock signals having phases opposite to each other to output a corresponding data signal to a following one of said pass transistors, N being an integer;

N feedback circuits connected on a one-to-one basis to a first N stages of said N+1 pass transistors, each of said N feedback circuits receiving a corresponding one of the data signals successively outputted from said corresponding one of the pass transistors, the N feedback circuits compensating for a drop of a signal level of the received data signal and outputting a resulting signal, said N feedback circuits being controlled by third and fourth clock signals having phases opposite to each other, the first to fourth clock signals are inputted independently of each other;

N output buffer circuits connected on a one-to-one basis to said N feedback circuits, each of said N output buffer circuits receiving a corresponding one of the resulting signals outputted from said corresponding one of the feedback circuits, the N output buffer circuits outputting the received resulting signals as scanning pulse signals; and clock signal applying means for applying one of a first driving condition and a second driving condition to said feedback circuits, wherein the first driving condition corresponds to the first and fourth clock signals having a first phase characteristic and the second and third clock signals have a second phase characteristic, the first phase characteristic being opposite to the second phase characteristic, wherein the second driving condition corresponds to the first and third clock signals having the first phase characteristic and the second and fourth clock signals having the second phase characteristic, and wherein the first driving condition causes the scanning pulse signals to be outputted from the N output buffer circuits in a forward direction beginning with the first scanning pulse signal and ending with the Nth scanning pulse signal, and the second driving condition causes the scanning pulse signals to be outputted from the N output buffer circuits in a reverse direction beginning with the Nth scanning pulse signal and ending with the first scanning pulse signal.

5. A driving method for an image device wherein a data signal is successively delayed and transferred in synchronism with a clock signal to produce scanning pulse signals to be outputted, the image device comprising:

N+1 pass transistors connected at a plurality of stages such that each of said pass transistors receives as an input signal thereto a data signal outputted from a preceding one of said pass transistors and is controlled by first and second clock signals having phases opposite to each other to output a corresponding data signal to a following one of said pass transistors, N being an integer;

N feedback circuits connected on a one-to-one basis to a first N stages of said N+1 pass transistors, each of said N feedback circuits receiving a corresponding one of the data signals successively outputted from said corresponding one of the pass transistors, the N feedback circuits compensating for a drop of a signal level of the received data signal and outputting a resulting signal, said N feedback circuits being controlled by third and fourth clock signals having phases opposite to each other, the first to fourth clock signals are inputted independently of each other;

N output buffer circuits connected on a one-to-one basis to said N feedback circuits, each of said N output buffer circuits receiving a corresponding one of the resulting signals outputted from said corresponding one of the feedback circuits, the N output buffer circuits outputting the received resulting signals as scanning pulse signals;

the driving method comprising the steps of:

a) when the scanning pulse signals are to be outputted from the N output buffer circuits in a forward direction beginning with the first scanning pulse signal and ending with the Nth scanning pulse signal, applying a first driving condition in which the first and fourth clock signals have a first phase characteristic and the second and third clock signals have a second phase characteristic, the first phase characteristic being opposite to the second phase characteristic; and b) when the scanning pulse signals are to be outputted from the N output buffer circuits in a reverse direction beginning with the Nth scanning pulse signal and ending with the first scanning pulse signal, applying a second driving condition in which the first and third clock signals have the first phase characteristic and the second and fourth clock signals have the second phase characteristic.

* * * * *